United States Patent [19]

Pozzi

[11] Patent Number: 4,733,683

[45] Date of Patent: Mar. 29, 1988

[54] AUTOMATIC RETRACTABLE BOX AWNING FOR RECREATIONAL VEHICLES AND THE LIKE

[75] Inventor: Carlo M. Pozzi, Ticino, Switzerland

[73] Assignee: Fiamma S.p.A., Cardano Al Campo, Italy

[21] Appl. No.: 893,572

[22] Filed: Aug. 5, 1986

[30] Foreign Application Priority Data

| | | | |
|---|---|---|---|
| Oct. 25, 1985 | [IT] | Italy | 83620 A/85 |
| Oct. 25, 1985 | [IT] | Italy | 83621 A/85 |
| Dec. 21, 1985 | [EP] | European Pat. Off. | 85116451-7 |

[51] Int. Cl.[4] ..... E04H 15/08; E04F 10/06

[52] U.S. Cl. ..... 135/89; 160/22; 160/68

[58] Field of Search ..... 135/89; 160/22, 68, 160/23 R, 19, 26

[56] References Cited

U.S. PATENT DOCUMENTS

| | | | |
|---|---|---|---|
| 848,509 | 3/1907 | Thoms | 160/22 X |
| 2,112,579 | 3/1938 | Schane . | |
| 2,755,082 | 7/1956 | D'Azzo . | |
| 3,364,973 | 1/1968 | Railson | 160/22 |
| 3,503,566 | 3/1970 | Travis | 242/55 |
| 3,722,571 | 3/1973 | Knight et al. | 135/89 X |
| 3,782,443 | 1/1974 | Clauss et al. | 160/22 |
| 3,833,011 | 9/1974 | Duffy | 135/89 |
| 3,918,510 | 11/1975 | Hayward | 160/68 |
| 3,991,805 | 11/1976 | Clauss | 160/22 |
| 4,164,972 | 8/1979 | Bennett | 160/66 |
| 4,171,013 | 10/1979 | Clark | 160/22 |
| 4,188,964 | 2/1980 | Greer | 135/89 |
| 4,214,621 | 7/1980 | Wessels et al. | 160/68 |
| 4,469,159 | 9/1984 | Lohausen | 160/22 |
| 4,615,371 | 10/1986 | Clauss | 160/22 |

FOREIGN PATENT DOCUMENTS

| | | | |
|---|---|---|---|
| 2459995 | 7/1975 | Fed. Rep. of Germany | 160/68 |
| 1550331 | 11/1968 | France | 160/68 |

*Primary Examiner*—J. Karl Bell

*Attorney, Agent, or Firm*—Lee C. Robinson, Jr.

[57] ABSTRACT

A retractable, roller-mounted fabric awning enclosed in a box-type assembly, which together with a releasable front bar, to which a front end of the awning is attached, thus forming a fully-enclosed housing for the awning, is provided for mounting on recreational vehicles and the like. A security lock mechanism to secure the front bar which contains a pair of pivotally mounted articulated folding support arms and a pair of pivotally mounted telescoping support legs, when the awning is in a retracted position, is provided to prevent the inadvertent detachment of the front bar from its releasably interlocking relationship with the awning box assembly while the awning is in a retracted position, and particularly when the vehicle to which the awning box assembly is mounted is being driven.

20 Claims, 42 Drawing Figures .

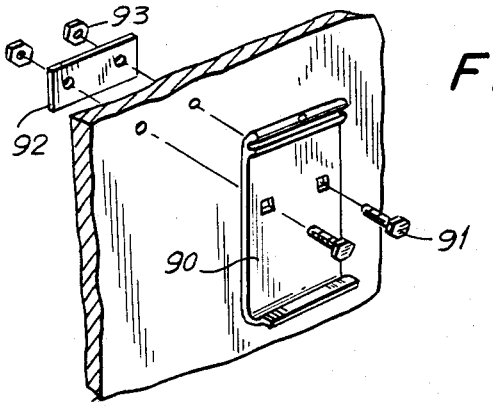
FIG. 3
FIG. 4
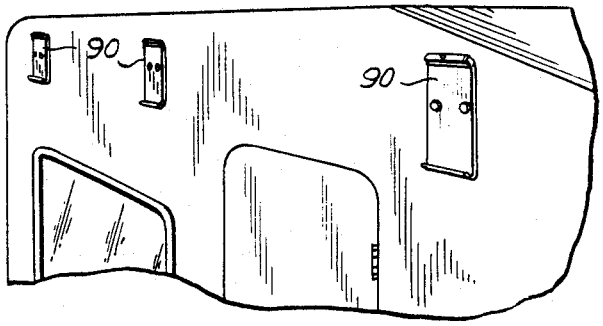
FIG. 5
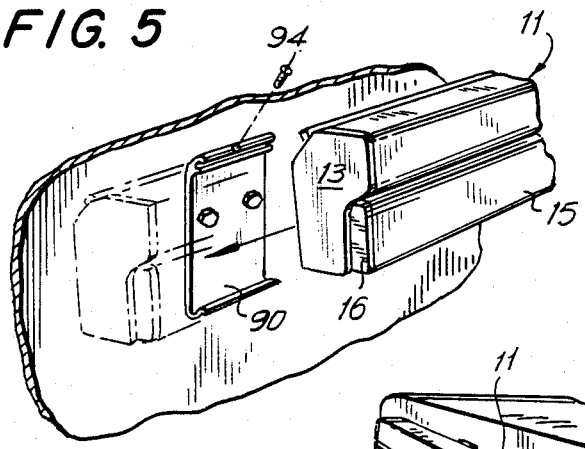
FIG. 6
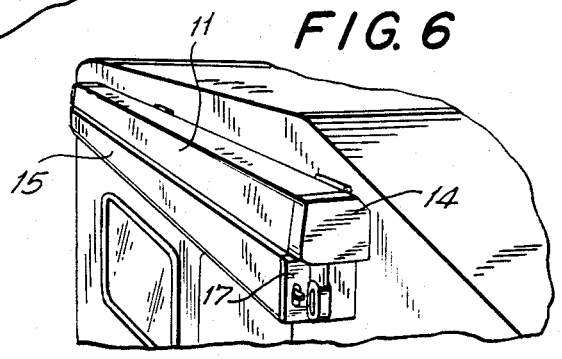

FIG. 11
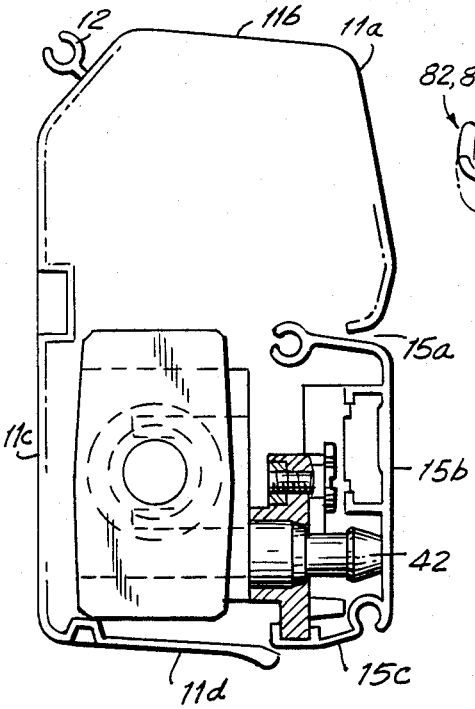
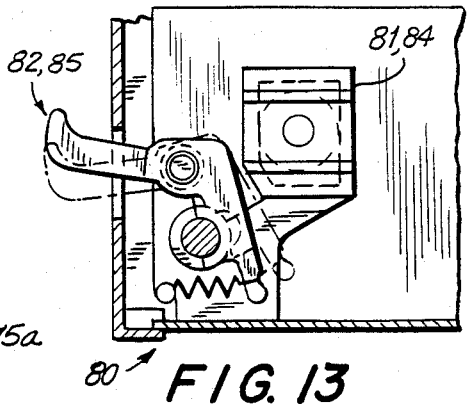
FIG. 13
FIG. 12
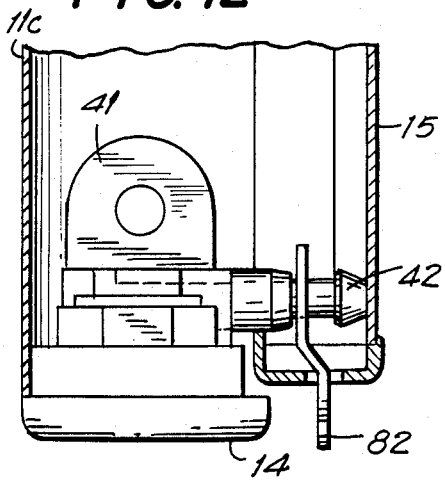
FIG. 14
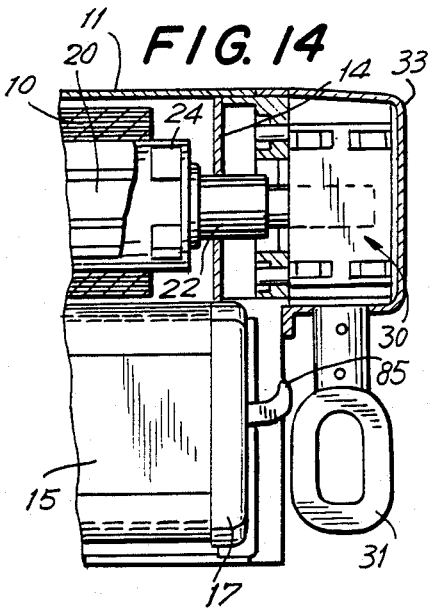

FIG. 19A
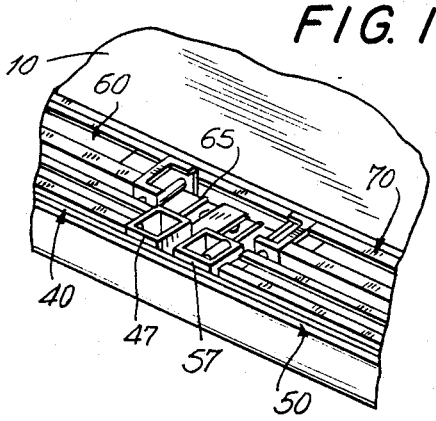
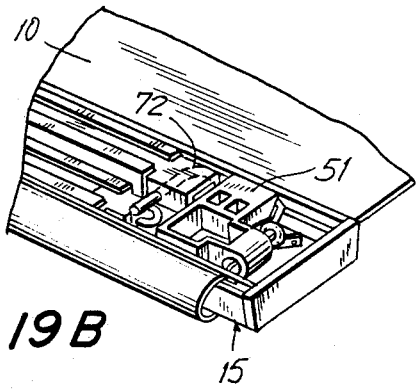
FIG. 19B
FIG. 20
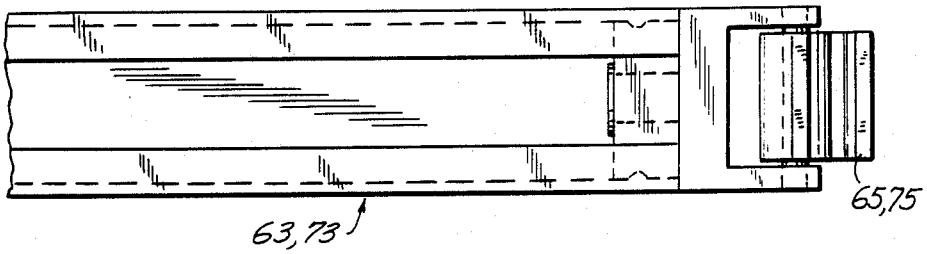
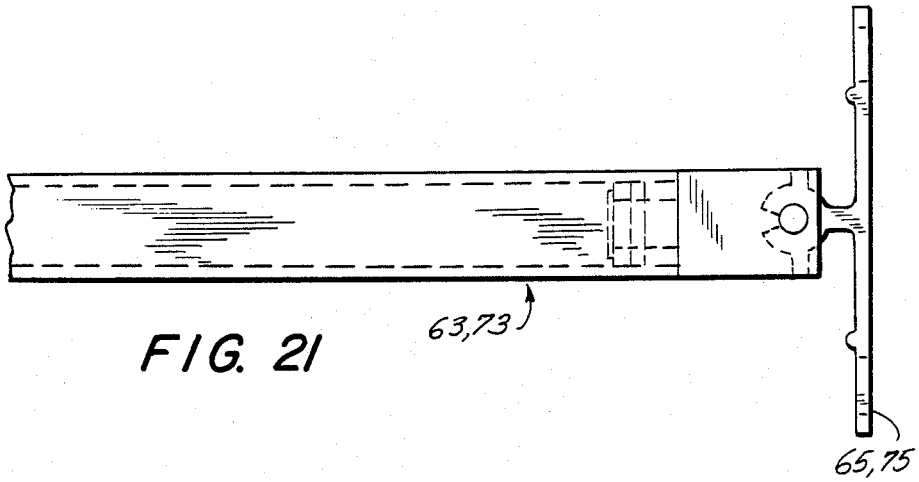
FIG. 21

FIG. 22
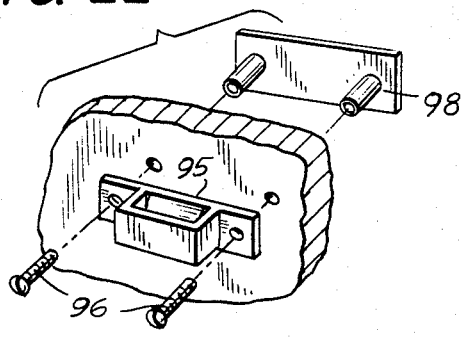
FIG. 24
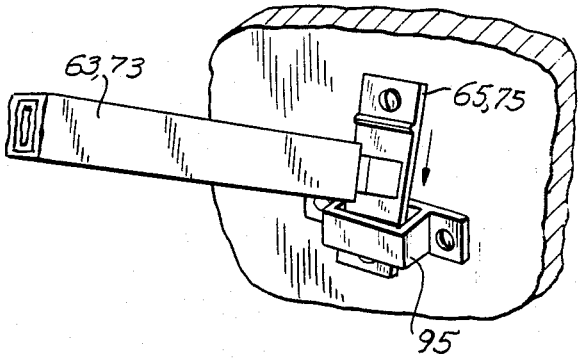
FIG. 23
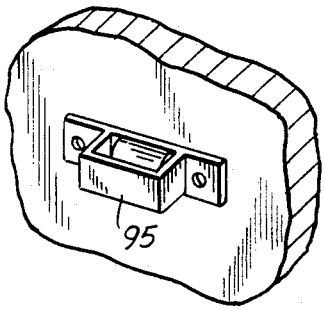
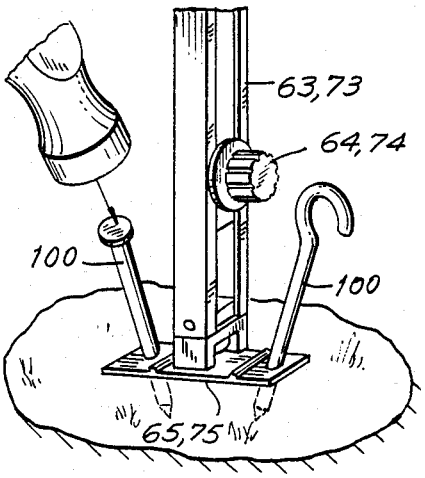
FIG. 25

FIG. 26A
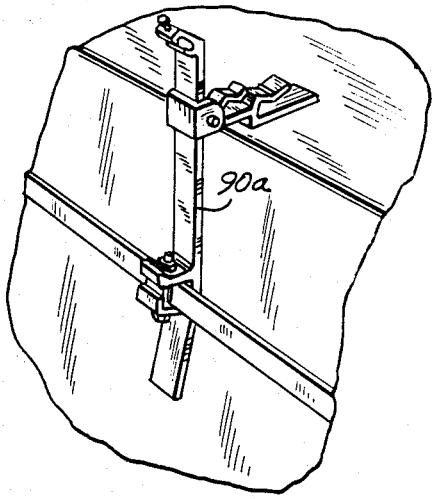
FIG. 26B
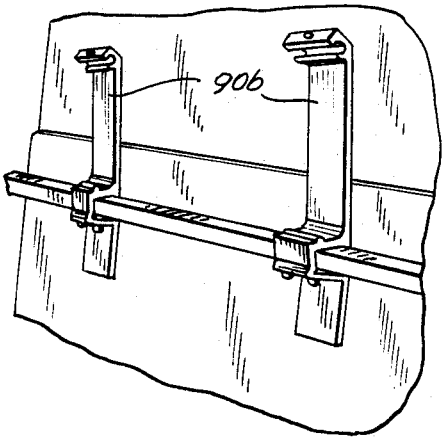
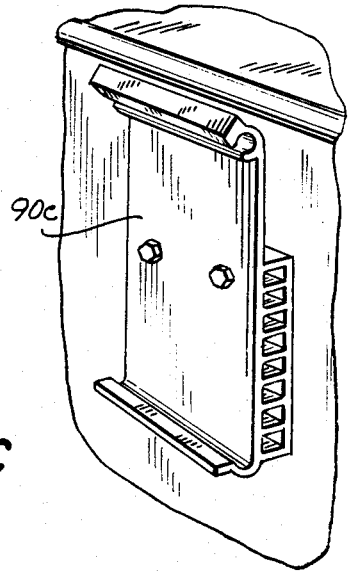
FIG. 26C

AUTOMATIC RETRACTABLE BOX AWNING FOR RECREATIONAL VEHICLES AND THE LIKE

FIELD OF THE INVENTION

This invention relates to awnings and, more particularly, to retractable, self-storing box-type awning assemblies with an automatic retraction mechanism for attachment to recreational vehicles and the like.

BACKGROUND OF THE INVENTION

A variety of retractable awning assemblies that provide a shaded or sheltered area when in an extended position, but which can be retracted into a housing or case for storage are known in the art. While such awnings can be used in a wide variety of situations, they are particularly suitable and have become very popular for use with recreational vehicles and campers to provide a covered outdoor area that provides shelter from the sun and rain when the vehicle is parked at a campsite.

A particular consideration in the design of such awning assemblies for use on recreational vehicles is that the housing be compact and streamlined so as not to cause wind drag effects which can seriously effect the steerability and performance of the vehicle when it is being driven on the road. It is desirable that the housing contain all of the awning parts, including the awning itself, as well as any support arms and legs, so as to limit the amount of additional hardware on the exterior of the vehicle, which would further impair the aerodynamics of the vehicle and which could become loose during travel thereby posing a potential safety hazard. By keeping all exterior hardware within an aerodynamically designed exterior housing, operation of the vehicle is substantially more fuel efficient and safer.

Moreover, it is desirable that such an awning have a safety lock mechanism that prevents the awning box from inadvertently opening and the awning from unrolling and/or the other stored awning parts from falling out, when the awning assembly is in a stored position and particularly when the vehicle to which it is attached is being driven on the road. The inadvertent, untimely deployment of the awning or parts of the assembly at such a time would pose an extreme safety hazard.

BRIEF SUMMARY OF THE INVENTION

One general object of this invention is to provide a new and improved awning.

More specifically, it is an object of the invention to provide a retractable awning assembly enclosed in a box-type housing which is capable of being mounted on recreational vehicles and the like.

An additional object of the invention is to provide such a retractable, box-type awning assembly for recreational vehicles in which the assembly is provided with support arms and support legs to give the awning increased stability when in an extended position.

A further object of the invention is to provide such an awing assembly in which the support arms and support legs are capable of being stored within a box assembly mounted on the vehicle. The box assembly has a streamlined appearance that does not adversely affect the operation and performance of the vehicle when it is being driven.

A still further object of the invention is to provide such an awning box assembly having a security lock mechanism which will prevent the inadvertent opening of the assembly and accidental deployment of the awning when it is in a stored position, particularly, when the vehicle is being driven.

A still further object of the invention is to provide such a retractable awning in a box-type assembly having support legs which are alternatively capable of being set-up on the ground or detachably affixed to the side of the vehicle when the awning is in an extended position.

In one embodiment of the invention, a rectangular fabric awning is attached at one end to a roller rotatably mounted in a box type assembly which is fully enclosed except for a front bar to which the opposite end of the awning is attached. The awning can alternatively be extended or retracted by a manual crank-turned operating mechanism which converts rotational motion of the crank into rotational motion of the roller. The roller is perpendicularly oriented with respect to the crank and, depending upon the direction of the rotation, causes the awning to extend or retract.

A preferred embodiment also includes a pair of pivotally articulated folding support arms at each end of the awning assembly. These arms are stored in a space within the front bar when the awning is in a retracted position and are arranged to unfold and deploy parallel to the direction of extension of the awning when it is being extended.

This embodiment also includes a pair of pivotally mounted telescoping support legs. The support legs are also stored within a space inside the front bar when the awning is in a retracted position, and the legs pivot and can be deployed when the awning is extended. The free ends of the support legs have footplates, which, when the support legs are extended, are capable of alternatively being set on the ground or being releasably attached to the side of the vehicle by way of special brackets mounted on the side of the vehicle.

In some embodiments of the invention a security lock mechanism maintains the front bar of the awning assembly in interlocking relationship with the remaining portion of the assembly when the awning is in a retracted position. The mechanism prevents the inadvertent detachment of the front bar and unwanted extension of the awning, particularly at such times when the vehicle to which the awning box assembly is mounted is being operated.

Several types of vehicle mounting brackets are provided to enable attachment of the awning box assembly to a wide range of domestic and foreing recreational vehicles having a variety of side wall shapes and configurations.

One alternative embodiment of the invention additionally provides for the releasable attachment of side and/or front flaps or screens to the awning when in an extended postion.

The present invention, as well as further objects and features thereof, will be more fully understood from the following description of certain preferred embodiment, when read with reference to the accompanying drawings.

BRIEF DESCRIPTION OF THE DRAWINGS

The invention is further described by way of example with reference to the accompanying drawings, in which:

FIG. 3 is an explosed fragmentary perspective view of a vehicle mounting bracket for the awning box assembly;

FIG. 4 is a fragmentary perspective view of the upper portion of a recreational vehicle showing a plurality of the vehicle mounting brackets illustrated in FIG. 3 mounted on the vehicle in a typical arrangement for accommodating the awning box assembly;

FIG. 5 is an exploded fragmentary perspective view showing the method of slidably mounting the awning box assembly onto the vehicle mounting brackets;

FIG. 6 is a fragmentary perspective view of the the awning box assembly in place on the vehicle;

FIG. 11 is a fragmentary cross-sectional view of the awning box assembly security lock system;

FIG. 12 is a plan view of the awning box assembly security lock system shown in FIG. 11, with portions shown in section;

FIG. 13 is a fragmentary cross-sectional view of the awning box assembly security lock system release lever;

FIG. 14 is a fragmentary detailed sectional view of the right end of the awning box assembly;

FIGS. 19 A–B are fragmentary detailed perspective views of the underside of the front bar showing stowage of the support arms and support legs;

FIG. 20 is a fragmentary detailed front view of the lower section of a support leg;

FIG. 21 is a fragmentary detailed side view of the lower section of the support leg shown in FIG. 20;

FIG. 22 is a fragmentary detailed perspective view of a vehicle wall mounting bracket for a support leg;

FIG. 23 is a fragmentary perspective view of the wall mounting bracket shown in FIG. 22 in place on the side of a vehicle;

FIG. 24 is a fragmentary perspective view showing the method of engaging a support leg in the wall mounting bracket shown in FIG. 22;

FIG. 25 is a fragmentary detailed perspective view showing the method of securing a support leg to the ground;

FIGS. 26A–C show alternative embodiments of the basic vehicle mounting bracket for the awning box assembly shown in FIG. 3;

DETAILED DESCRIPTION OF CERTAIN PREFERRED EMBODIMENTS

Figure 29:
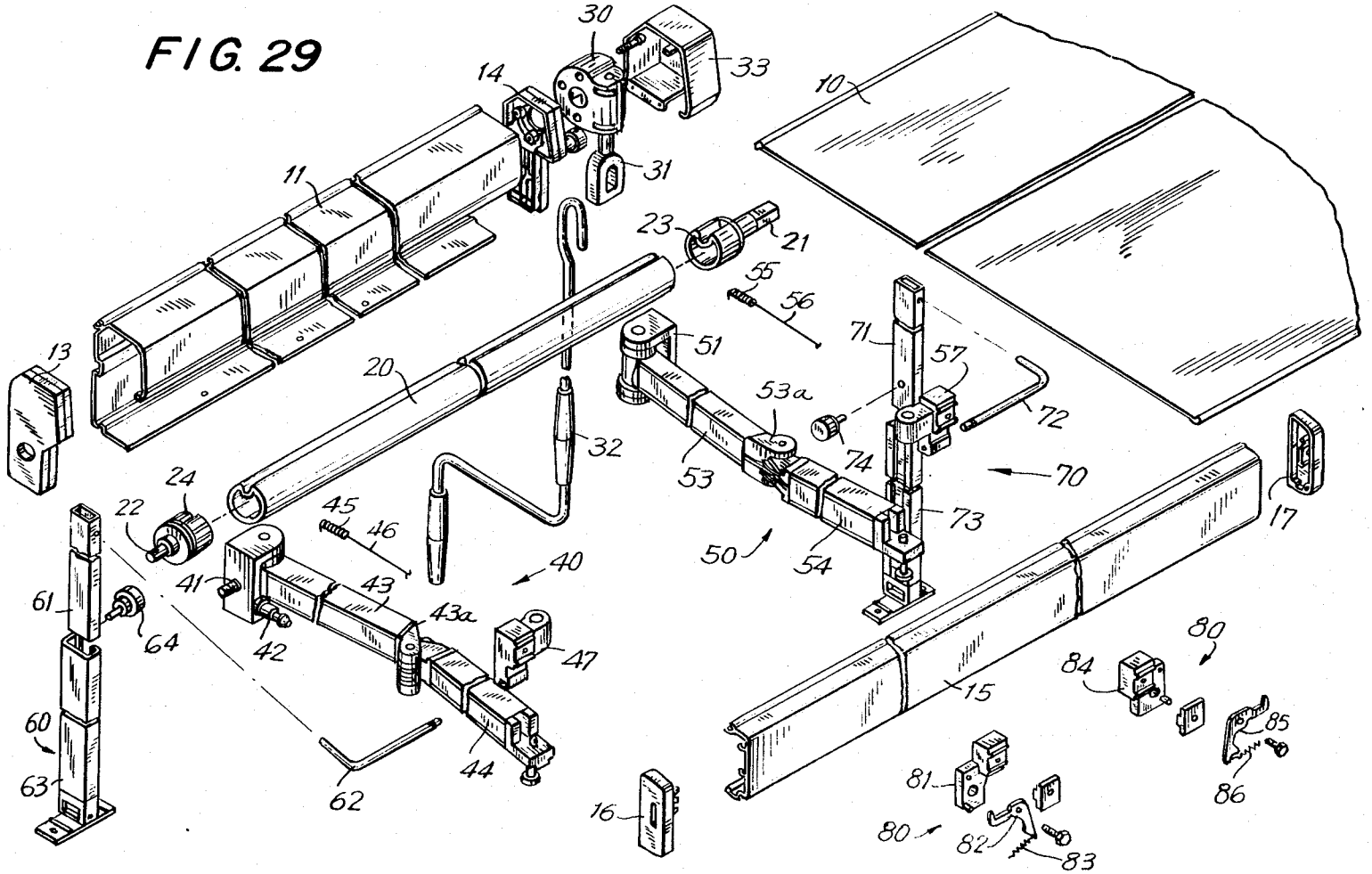
FIG. 29 is an overall exploded view of the principal components of one embodiment of the invention.

Referring generally to FIG. 29, the automatic, box awning assembly generally comprises an awning 10, a box structure 11 constituting the body of a case, a front bar 15 that combines with the box-like structure to form an enclosed case, a roller 20 for rolling up the awning, roller winding/unwinding operating mechanism 30, a pair of foldable, articulated support arms 40, 50, each pivotally attached at one end to an end of box 11 and at an opposite end to an end of the front bar 15, a pair of telescoping support legs 60, 70, each pivotally and rotationally mounted at one end to an end of the front bar 15, such that the pair of support arms 40, 50 and support legs 60, 70 are capable of being stored within a space in the front bar 15, when the awning is in a rolled-up storage position, and a security lock mechanism 80 for releasably securing the front bar 15 to the box 11, when the awning is in a rolled-up storage position. These basic components and their features and operation will be described more fully in the following detailed description.

Figure 1:
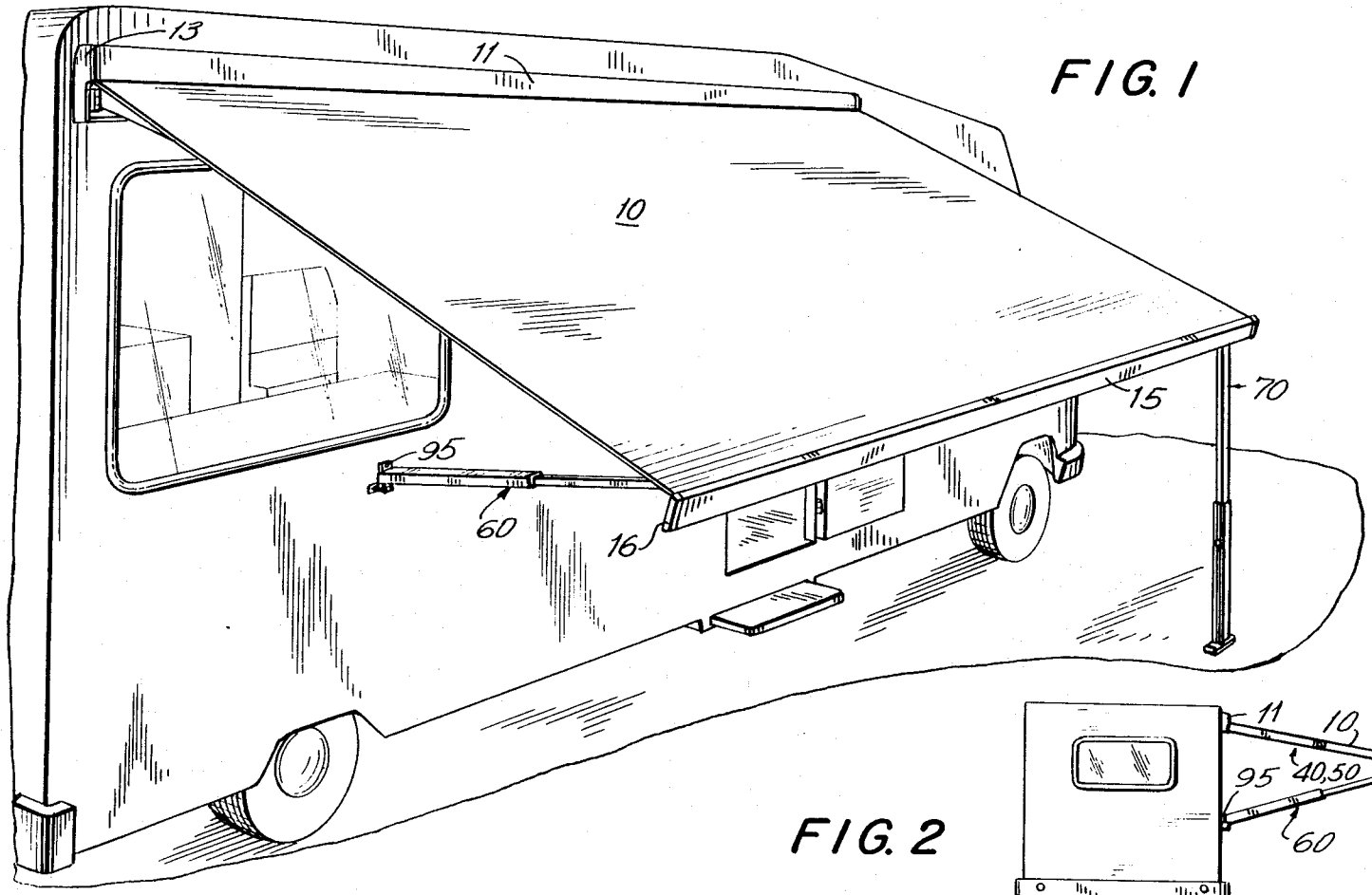
FIG. 1 is a perspective view of an exemplary automatic-box awning assembly constructed in accordance with the present invention, along with a portion of a recreational vehicle to which it is attached, the awning assembly being shown in the extended position.
Figure 2:
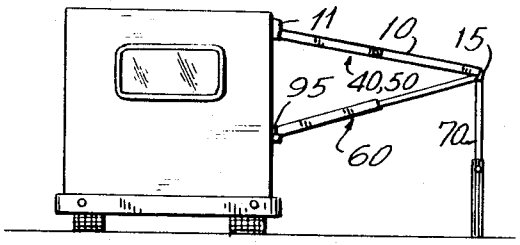
FIG. 2 is an end elevational view of the assembly and vehicle of FIG. 1 showing the assembly in the fully extended position on the side of a recreational vehicle with one support leg resting on the ground and the other support leg releasably attached to the side of the vehicle.

The awning assembly is particulary suitable for attachment to the side of a recreational vehicle, as shown in FIGS. 1 and 2, with the box 11 secured in a horizontal position on the side of the vehicle near the top.

The awning box 11 is attached to the side of the vehicle generally using a plurality mounting brackets 90 illustrated in FIG. 3. These brackets 90 are affixed to the side of the vehicle, such as with bolts 91 and nuts 93, according to the method shown in FIG. 3, to form a typical arrangement of the vehicle mounting brackets along the upper side of the vehicle, as is shown in FIG. 4. An optional mounting bracket backplate 92, having appropriately spaced holes drilled therethrough in positions corresponding to those of the mounting bracket bolts 91, may be used to distribute the load which the awning box assembly adds to the side of the vehicle after being mounted.

The number of vehicle mounting brackets used in a given situation is determined by several factors, including the length and weight of the particularl awning box assembly and the shape and configuration of the side of the vehicle. Accordingly, for vehicles having a relatively flat upper side portion, such as is shown in FIG. 4, acceptable mounting of the awning box assembly is achieved by utilizing a pair of vehicle mounting brackets affixed near the ends of the awning box assembly, for awnings less than or equal to eight feet in length; and at least three vehicle mounting brackets should be used for awning box assemblies eight feet or greater in length, with one vehicle mounting bracket being affixed to the vehicle near each end of the awning box assembly, and the third and any additional brackets being affixed near the center of the awning box assembly to prevent its sagging.

In any situation, additional vehicle mounting brackets beyond the recommended minimum can be used to insure a secure attachment of the awning box assembly to the side of the vehicle. The only consideration in using a greater number of vehicle mounting brackets is that all must be properly aligned along the side of the vehicle so as to insure smooth movement of the awning box assembly through the grooves of the vehicle mounting brackets when the awning box assembly is being slid onto the vehicle mounting brackets by the method shown in FIG. 5.

Referring to FIG. 5, the awning box assembly 11 is slid onto the vehicle mounting brackets 90 in the direction of motion of the arrow, with the rails on the awning box assembly engaging the grooves on the vehicle mounting bracket; the dashed outline of the end of the awning box assembly shows the final position after mounting. A correctly mounted awning box assembly on the side of a vehicle is shown in FIG. 6, with the awning box assembly being mounted on the arrangement of vehicle mounting brackets shown in FIG. 4, using the method of mounting according to that shown in FIG. 5.

One of the advantages of this arrangement is that the awning box assembly may be easily mounted on a variety of recreational vehicles having a wide range of side shapes and configurations. The basic vehicle mounting bracket 90 shown in FIG. 3 is suitable for those vehicles having a flat upper side panel at least as long as the length of the awning box assembly to be affixed to the vehicle and not having any protruding or overhanging edges which would interfere with the clearance of the awning box assembly when mounted. For vehicles having curved or angular side configurations, such as is shown in FIGS. 27 B–H, alternative types of vehicle mounting brackets 90*a*, 90*b* and 90*c* have been developed to accommodate mounting of the awning box assembly to such types of vehicles. The mounting brackets 90*a, b, c* also are shown in FIGS. 26 A–C. These alternative types of mounting brackets accommodate the awning box assembly to many types of domestic and foreign manufactured recreational vehicles. For certain types of vehicles, mounting of the awning box assembly to the vehicle is best effected by utilizing a combination of the several types of mounting brackets. Representative combinations of the types of vehicle mounting brackets for the various vehicle configurations shown in FIGS. 27A–H are also shown on those figures, with the numbers adjacent to each figure representing the vehicle mounting bracket types illustrated in FIGS. 3 and 26 A–C.

An alternative method for affixing the vehicle mounting brackets to the side wall of the vehicle and mounting the awning box assembly thereon requires pre-drilling of holes in the side of the vehicle to accommodate the vehicle mounting brackets. After the holes are pre-drilled into the side of the vehicle at appropriate spacings and locations, followed by insertion of the vehicle mounting bracket bolts 91 through the holes in the wall mounting grackets 90, the wall mounting brackets and bolts are then slid on to the awning box assembly by engaging the rails 12 on the upper and lower edges of the back panel 11*c* of the box assembly 11 with the grooves at the top and bottom of each vehicle mounting bracket. The entire assembly is then positioned on the side of the vehicle, with the protruding bolts inserted through the corresponding pre-drilled holes in the side of the vehicle, followed by securing the assembly from inside the vehicle utilizing the vehicle mounting bracket nuts 93 and optionally the vehicle mounting bracket back plates 92.

Other alternatives, such as illustrated in FIGS. 26A and B, utilizing alternative vehicle mounting brackets 90*a* and 90*b* mount the awning box assembly onto a roof luggage rack of the vehicle, thereby avoiding the necessity of drilling holes in the side and/or roof of the vehicle.

In order to prevent the awning box assembly from sliding after having been mounted on the vehicle wall mounting brackets 90, 90*a*, 90*b*, 90*c*, each such bracket has a hole centrally located in the upper portion of the groove through which the upper rail 12 of the box slides during mounting. A lock nut 94 is inserted through the hole in the vehicle mounting bracket 90, 90*a*, 90*b*, 90*c*, and tightened until it communicates with the rail 12 of the box 11 which is in the groove to thereby prevent undesired further sliding of the rail 12 and movement of the entire awning box assembly 11 through the vehicle mounting brackets 90, 90*a*, 90*b*, 90*c*.

As is best shown in FIGS. 5 and 6, the awning assembly comprises a box-like structure, which together with front bar 15 and box end plates 13, 14 forms a fully enclosed housing for the awning. The main portion of the box 11 is made up of a number of contiguous portions, including a front panel 11*a* (FIG. 11), a top panel 11*b*, a back panel 11*c* and a bottom panel 11*d*. Front panel 11*a* of box 11 extends partially down the front of the box, being of shorter length than the corresponding back panel 11*c*, which it oppositely faces. The leading edge of the top panel 11*b* has a slight inward curve facing toward the interior of the box. The balance of the height of the front face of the box corresponds to a distance of the back panel 11*c* not having a corresponding portion of the front panel 11*a* adjacent to it. The back panel 11*c*, except for a short section near its upper edge which accommodates the upper box mounting rail 12, is vertically oriented with respect to the top panel 11*b* and bottom panel 11*d* of the box 11. The front panel 11*a* of the box 11 has a slight outward and downward slope with respect to the top panel 11*b* and bottom panel 11*d*. The bottom panel 11*d* is somewhat narrower than the top panel 11*b*. The distance between the lower edge of the front panel 11*a* and the front edge of the bottom panel 11*d* is determined by the width of the front bar 15, the upper and lower inner leading edges of which cooperate with the lower leading edge of the front panel 11*a* and the forward leading edge of the bottom panel 11*d*, respectively. The width of front bar 15, in turn, is determined by the feature of the invention wherein the front bar 15 acts as a storage compartment for a pair of foldable, articulated support arms 40, 50 and a pair of telescoping support legs 60, 70, as is more fully described below. The open ends of the box 11 are sealed by left and right box end plates 13, 14, respectively, both of which have the same general configuration as the sides of box 11.

The parts of the awning box 11, as well as the box endplates 13, 14 and the front bar 15 can be fabricated from any strong, weather resistant, non-corroding metal or plastic. Excellent results have been obtained by fabricating the box and its associated components out of anodized aluminum. This material has the advantage of being strong yet easily shaped and is resistive to corrosion.

The right box end plate 14 has a circular opening in the center thereof to accommodate one end of a shaft 21 fixedly attached to a roller 20 by way of roller end cap 23.

Each box end plate 13, 14 has a circular opening in the lower portion thereof through which a support arm rear pivoting joint 41, 51, as will be described, is mounted.

The left box end plate 13 has a circular groove on the inner surface of the upper portion thereof, corresponding to the location of the circular opening in the upper portion of the right box end plate 14. The groove in the left box end plate 13 cooperates with and allows the free rotation of left roller shaft 22 therein. Left roller shaft 22 is affixed to left roller end cap 24, which in turn, is fixedly attached to the left end of the roller 20.

The roller 20, has left and right roller end caps 23, 24 attached thereto. The end caps, in turn, have left and right roller shafts 21, 22 attached thereto. The roller 20 is rotatably mounted in box 11 by having the left roller shaft 22 rotatably mounted in the groove in left box end plate 13 and the right roller shaft 21 inserted through and rotatably mounted in the circular opening in the top portion of right box end plate 14. The end of right roller shaft 21 has an additional rectangular shaft portion which protrudes beyond right box end plate 14. The rectangular shaft portion of right roller shaft 21 engages with a rectangular opening in roller operating mechanism 30.

Roller operating mechanism 30, is coaxially affixed to the roller 20, by way of the right roller shaft 21. Roller operating mechanism 30 cooperates with and has rotatably attached thereto crank stirrup 31. Crank stirrup 31 is perpendicularly rotatably attached to roller operating mechanism 30 and cooperates with the roller operating mechanism 30 by rotating at right angles to the roller operating mechanism. Crank 32 detachably engages with crank stirrup 31. The crank 32 has a hooked portion at one end thereof which engages with crank stirrup 31. Rotation of the crank 32 causes rotation of the crank stirrup 31. This rotating motion in one plane of movement is translated by roller operating mechanism 30 into rotational motion in a perpendicular plane, which causes the roller 20 to rotate and the awning 10 to either extend or retract, depending upon the direction of motion of the roller 20. The roller operating mechanism 30 engages with the roller 20 by way of engagement of the rectangular end piece of right roller shaft 22 with a correspondingly shaped opening in the mechanism 30, which is coaxially oriented with the shaft 21. The direction of motion of the roller 20, in turn, is determined by the direction in which the crank 32 is being turned.

The roller mechanism 30 is enclosed in a housing 33 having the same shape and contour when viewed from the side as box 11, thus effectively forming an extension of box 11 to maintain the smooth aerodynamic lines of the box. The housing 33 is of sufficient length to enclose roller mechanism 30.

FIG. 14 shows details of the roller operating mechanism 30 and its relative orientation with respect to the roller 20 and the crank stirrup 31. This figure also shows the box 11 and roller mechanism housing 33 with front bar 15 attached to form an overall enclosure for the awning assembly.

In an alternative embodiment of the invention, the crank 32 and crank stirrup 31 are replaced with an electric motor to drive the roller 20 and cause the awning to alternatively extend or retract. Controls for operating the electric motor drive are conveniently mounted on the vehicle and can be located inside or outside the cabin of the vehicle or in the driving compartment.

The awning 10 itself, is a generally rectangular shaped piece of fabric, having dimensions of width equal to the width of the roller 20 and a length ranging from approximately 7 feet to 13 feet, in order to provide an actual effective extended length ranging from approximately 6 feet to approximately 12 feet.

The actual effective length of the awning is determined by the length of the folding, articulated support arms 40, 50 will become evident upon the further description of these elements below. The length of these arms, when fully extended, fixes the effective length of the awning.

The material of the awning 10 can be any fabric having good strength and weather resistance. The material should also be resistant to dimensional variation, such as stretching or shrinking in any direction, particularly due to exposure to the weather and external agents. The material should also be mold and mildew proof. In particular, the fabric should be resistant to weather elements such as sun, wind, and rain.

Polyester, lined on both sides by PVC (poly-vinyl chloride) has been found to be a material best suited for use as the awning 10.

The awning 10 may be fabricated either from one continuous piece of material, or, especially where a pattern of alternating colored strips is desired, can be fabricated from different colored strips which have been joined together. Where the awning 10 is fabricated from such a series of joined narrower strips, which may be of the same or different colors, a better awning, having better waterproof characteristics and a generally longer operational life, results where the strips are joined by welding, rather than by stitching.

Thus, alternatively, the awning can be made of a single piece of fabric solidly color or printed in a variety of pattern and designs on one or both sides, or it can be made of a plurality of strips ranging from several inches to several feet in width, solidly colored or printed on one or both sides, which are welded together.

One edge of the awning 10 in the direction of its width is fixedly attached to the roller 20 across its full length. The outer periphery of the roller 20 has a notch 25 in the surface thereof extending coaxially along the full length of the roller. The leading edge of the awning 10 is secured to the roller along this notch. The opposite edge of the awning 10 in the direction of its width is fixedly attached to the inside of a top panel **15*a* of the front bar 15 at the trailing edge of the top panel 15*a* and across the full length of the front bar 15**.

In the fully retracted state, the fabric of the awning 10 is fully wound around the roller 20.

Left and right support arms 40, 50 respectively, are attached to the awning box assembly 11 at its respective ends. The left and right support arms 40, 50, respectively, which are articulated, having pivotally movable front and rear sections, are attached at one end to the awning box assembly 11 and at the other end to front bar 15. The support arms serve to uphold the front bar to which the leading ledge of the awning material 10 is attached and further serve to uphold the sides of the awning material 10 itself, thereby preventing the sides of the awning material from sagging, when the awning is in an extended position.

Each support arm has a rear pivoting joint 41, 51 which is fixedly attached to the awning box assembly by means of a bolt mounted on a flat end thereof, which is inserted through the circular opening in the lower portion of the corresponding box end plate 13, 14 at either end. Each rear pivoting joint 41, 51 has a security lock post 42, 52, fixedly attached to the lower surface thereof near its outer periphery, that is, outward of a rear section of the support arm 43, 53, which is pivotally attached to the respective left and right rear pivoting joints 41, 51. The security lock posts 42, 52 cooperate with left and right security lock mechanism levers 82, 85 which constitute part of a security lock mechanism 80 for securely holding the front bar 15 assembly to the awning box 11 assembly when the awning is in a fully retracted position. The operation of this security lock mechanism is more fully described below.

Figure 17:
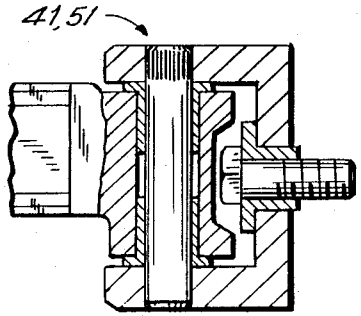
FIG. 17 is a fragmentary detailed sectional view of a support arm rear pivoting joint.

Each support arm rear pivoting joint 41, 51 pivotally cooperates with a support arm rear section 43, 53. The support arm rear sections 43, 53 have vertical pins at the top and bottom surfaces of the end which cooperates with the support arm rear pivoting joints 41, 51. These pins rotatably engage with circular openings in a top and bottom flange on each support arm rear pivoting joint 41, 51, which allows the support arm rear sections 43, 53 to rotate through a 90 degree arc, one terminus of which is fixed in a direction parallel to the awning box 11 and the other terminus of which is fixed in a direction perpendicular to the awning box 11. Details of the support arm rear pivoting joints are shown in FIG. 17. The support arm rear sections 43, 53 are capable of rotating through the above-mentioned 90 degree arc in a horizontal plane and inwardly towards the center of the awning.

The front portion of each support arm rear section 43, 53, opposite to the rear end thereof which is pivotally attached to the support arm rear pivoting joints 41, 51, terminates in a pivoting joint **43*a*, 53*a* having upper and lower flanges with circular openings drilled therethrough for accommodating vertically and coaxially oriented pins attached to support arm front sections 44, 54** as is next described.

Figure 8A:
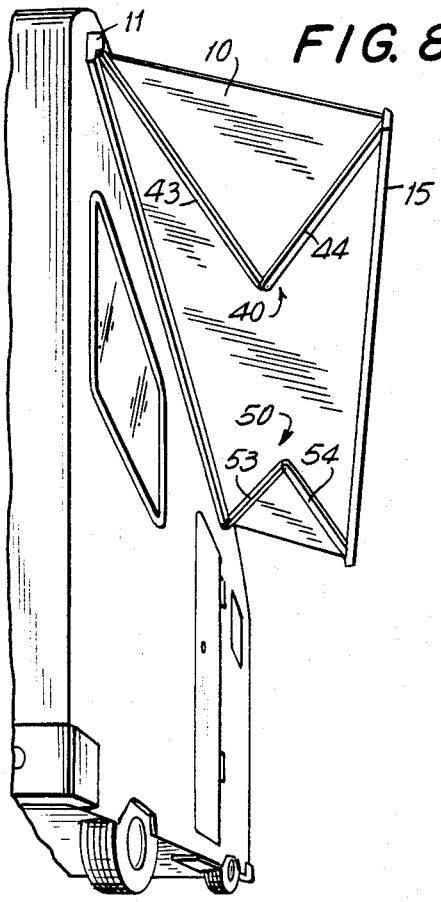
FIGS. 8 A–B are fragmentary perspective views showing intermediate stages in the deployment of the awning.
Figure 8B:
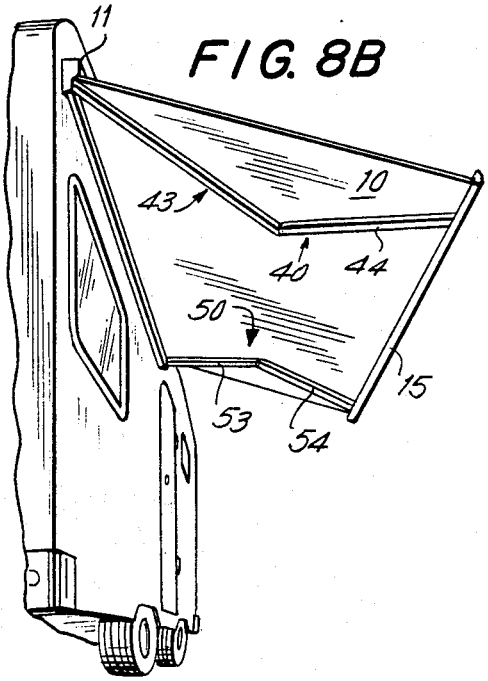

Each support arm rear section 43, 53 pivotally cooperates with a support arm front section 44, 54. The rear of each support arm front section 44, 54 has a vertical pin on the top and bottom surface thereof, which pins engage with vertically oriented holes in the front pivot joint at the front of the support arm rear sections 43, 44. The support arm front sections 44, 54 are capable of pivoting in a 180 degree arc about the axis of their pivotal joint with the support arm rear section. The support arm front sections 44, 54 are thus capable of assuming positions in the range of from being parallel to and side-by-side with the support arm rear sections 43, 53, that is, at a 0 degree orientation to the support arm rear sections, to a position that is coaxial to the support arm rear sections, that is, oriented at an angle of 180 degrees thereto. The first-mentioned position of the support arm front sections with respect to the support arm rear sections corresponds to the position of retraction of the awning wherein the support arm front and rear sections are stored within the front bar 15 of the awning, as will be described. The second-mentioned position corresponds to the position of maximum extension of the awning. Intermediate positions of the support arm front and rear sections, wherein the support arm rear sections deploy to positions along their 90 degree arc of movement and the support arm front section deploy in various positions along their 180 degree arc of movement, correspond to positions of intermediate extension of the awning between its initial rolled up position and its final fully extended position. The intermediate positions of the support arms 40, 50 as the awning is extended are more clearly shown in FIGS. 8 A–B.

Figure 9:
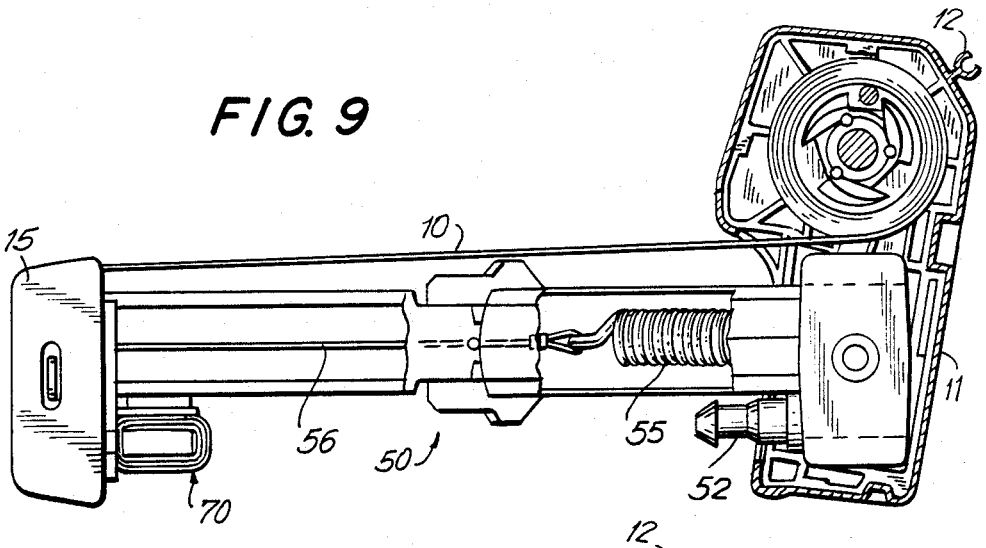
FIG. 9 is a fragmentary detailed side view, with a portion shown in section, of an automatic winding mechanism and a support arm at the initial stage of awning deployment with the awning material still substantially wound around the roller.
Figure 10:
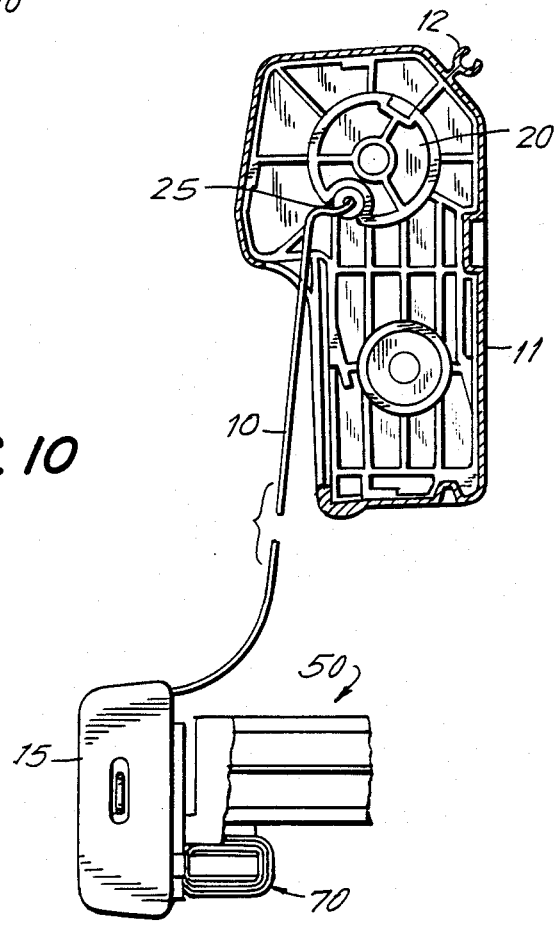
FIG. 10 is a fragmentary detailed side view, with a portion shown in section, of the automatic winding mechanism and split view of the front bar and end of a support arm with the awning fully extended and unwound from the roller.
Figure 15:
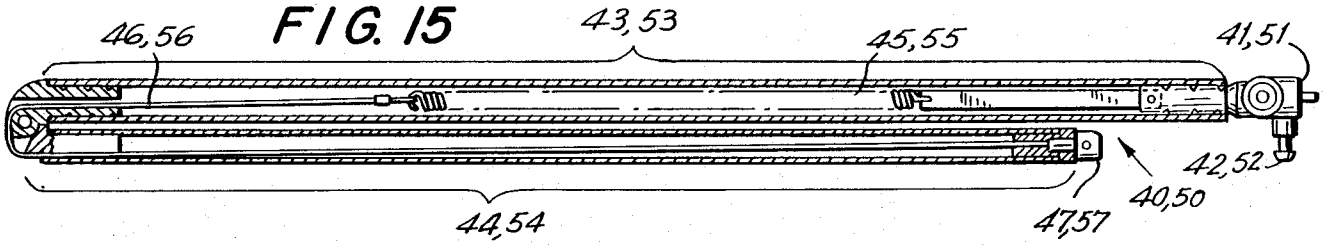
FIG. 15 is a detailed sectional view of the support arm.
Figure 16:
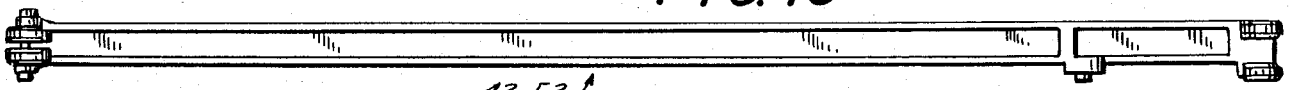
FIG. 16 is a side view of the support arm in FIG. 15.
Figure 18:
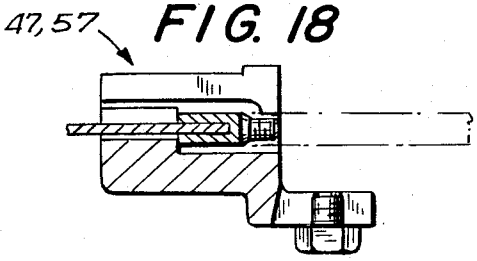
FIG. 18 is a fragmentary detailed sectional view of a support arm front pivoting joint.
Figure 27A:
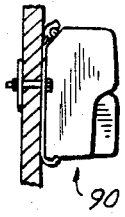
FIGS. 27A–H are fragmentary detailed sectional views showing various vehicle contours to which the awning box assembly can be affixed using the vehicle mounting brackets shown in FIGS. 26A–C.
Figure 27B:
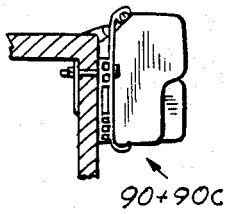
Figure 27C:
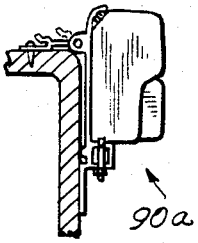
Figure 27D:
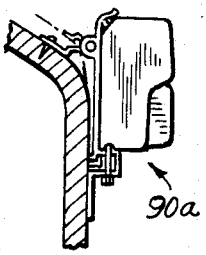
Figure 27E:
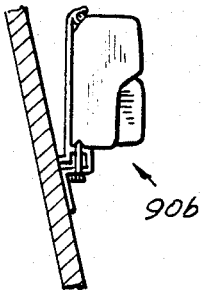
Figure 27F:
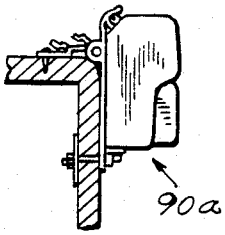
Figure 27G:
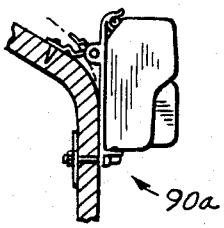
Figure 27H:
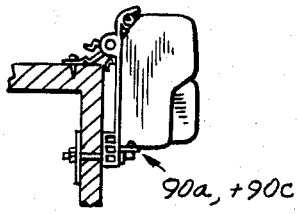

Deployment of the support arms 40, 50 is coordinated with the extension or retraction of the awning and is controlled by a spring and cable tension mechanism in the support arms themselves. The support arm front sections 44, 54 and rear sections 43, 53 are fabricated in a tubular manner to accomodate the spring and cable. The relationship of the support arms 40, 50 to the awning box assembly 11 and the front bar 15 is more clearly indicated by FIG. 9. The location of the support arm tension spring 44, 55 and cable 46, 56 within a support arm is also more clearly seen by the partial cut away view of a side arm in this figure. FIG. 15 shows a support arm in folded position, as for storage in the front bar 15 when the awning is in a retracted position. This view also shows a support arm tension spring 45, 55 in dashed outline and a support arm cable 46, 56, also in dashed outline. One end of each support arm tension spring 45, 55 is fixedly attached to each support arm pivoting joint 41, 51. The opposite end of each support arm tension spring 45, 55 is attached to one end of a support arm cable 46, 56. The opposite end of each support arm cable 46, 56 is, in turn, attached to a support arm front pivoting joint 47, 57. The support arm tension springs 45, 55 are in a first position wherein there is no spring tension when the support arms are in their folded positions, parallel to the awning box assembly 11, with the awning in a retracted position. FIG. 16 is a detailed side view of the overall support arm 40, 50. FIG. 18 is a detailed view of a support arm front pivoting joint 47, 57.

As the awning 10 begins to extend in response to the turning of the crank 32 in a direction which causes the roller operating mecahnism 30, in turn, to cause the roller 20 to turn in a direction whereby the awning 10 unwinds from the roller 20, tension in the support arm tension springs 45, 55 increases as the support arms 40, 50 deploy to their fully extended length with the awning in a fully extended position.

The converse occurs when the crank 32 is turned in an opposite direction thereby causing the roller operating mechanism 30 to cause the roller 20 to rotate in an opposite direction thereby retracting the awning 10. In that case, the support arm tension springs 45, 55 and support arm cables 46, 56 cause the support arm front sections 44, 54 to fold inward upon the support arm rear sections 43, 53 with the tension in the support arm tension springs 45, 55, gradually being reduced until the overall support arms 40, 50 are again in their fully-folded position stored in the inside of the front bar 15, with the awning then being in its fully retracted position.

Another novel feature of the invention is the use of a pair of support legs 60, 70 to further support the front bar 15 of the awning 10 generally when the awning is in a fully-extended position. Each support leg 60, 70 includes a support leg upper section 61, 71 which telescopes into a support leg lower section 63, 73. Support leg tigthening knobs 64, 74 are used to tighten the support legs to the required variably adjustable height. The support legs 60, 70 are pivotally attached to the support arm front pivoting joints 47, 57 by way of support leg pivoting rods 62, 72. The support leg pivoting rods 62, 72 are L-shaped rods, one end of which is inserted through a forward-facing hole in the top of each support leg upper section and the other end of which cooperates with a grooved channel in each support arm front pivoting joint 47, 57.

The support legs are capable of moving through a 90 degree arc in a vertical plane such that they are oriented parallel to the awning box assembly 11 when in the 0 degree position and perpendicular to the awning box assembly 11 when in the 90 degree position. The support legs 60, 70 are also capable of pivotal motion in a plane perpendicular to the awning box assembly 11. The support legs 60, 70 are capable of movement through a 90 degree arc in this perpendicular plane. The support legs 60, 70 rest on and are perpendicularly oriented towards the ground when in the 90 degree position. The support legs 60, 70 are oriented perpendicularly to a vertical plane through the awning box assembly and side of the vehicle and are capable of being detachably affixed to the side of the vehicle, as will be more fully described below, when in the 0 degree position.

One of the novel aspects of this awning is that all external parts of the awning are capable of being stored within the overall box or case of the awning when the awning is in the retracted position. This provides for a streamlined design when the awning is mounted on the side of a vehicle. As part of this feature, the support legs 60, 70 with the upper sections 61, 71 telescoped into the lower sections 63, 73, are inwardly folded towards the center of the awning box assembly and oriented in the 0 degree position in the vertical plane, as described above, to be storable within the inside of the front bar 15.

FIG. 19 shows a detailed view of the underside of the front bar 15 showing the manner in which the folded support arms 40, 50 and telescoped support legs 60, 70 fit in the space in the front bar formed by top 15*a*, front side 15*b*, bottom 15*c* of the front bar and front bar endplates 16, 17 when the awning assembly is in its storage position.

Each support leg lower section 63, 73 (FIG. 25) has a support leg foot plate 65, 75 pivotally attached to the bottom end thereof. The footplates 65, 75 serve to stabilize the support legs 60, 70 when they are in extended position on the ground. These footplates 65, 75 reduce the ground pressure of the support legs by distributing their load over a larger surface area than that of the ends of the support legs themselves and overcome any destabilizing effects on the legs due to slightly uneven terrain. The footplates 65, 75 can be uni-directionally pivoted with respect to the bottom of the support legs, with the direction of pivoting being in a vertical plane parallel to the front of the awning box assembly. Alternatively, the footplates 65, 75 can be joined to the bottom of the support leg lower section 63, 73 by means of a ball-and-socket type joint, so as to be capable of leveling motion in all directions with respect to the ground surface. In this case, the bottom end of the support leg lower sections 63, 73 should terminate in a socket-type joint, with the support leg footplates 65, 75 having a flat, preferably circular shaped plate with a central post terminating in a ball-type connector which cooperates with the socket joint at the bottom end of the support leg lower section 63, 73.

In any case, the flat surface of the footplates 65, 75 have a plurality of holes drilled through their surface, through which support leg anchor pins 100 can be hammered to more tightly secure the footplates to the ground surface. In this case of rectangular-shaped footplates, at least one such hole should be drilled through each side of the footplate. In the case of circular-shaped footplates, at least two, and preferably three or four such holes should be drilled at equidistant points around the footplate at some radial distance near its outer edge.

FIGS. 20 and 21 are side and end views, respectively of the details of the support leg lower section 63, 73, showing the embodiment with a pivoting foot plate 65, 75.

Support leg anchor pins 100 are solid pins, preferably of metal, of from approximately 6 to 8 inches in length. They have a tapered, semi-sharpened tip at one end thereof to facilitate penetrating a hard ground surface and alternatively have a hooked opposite end capable of engaging the edge of the footplate or a flared end with a flared end piece at least slightly larger than the diameter of the hole in the footplate so as to be capable of holding the footplate in place and not slipping through the hole in the footplate.

Another novel feature of the awning assembly is the security lock mechanism 80 at both ends of the awning which serves to prevent inadvertent disengagement of the front bar 15 positioned in cooperation with the awning box 11 to form an enclosed housing for the entire awning assembly when the awning is in the retracted position, and particularly when the vehicle is being driven.

The security lock mechanism 80 at each end of the awning assembly includes a security lock mechanism mounting bracket 81, 84 affixed to the inside of each end of the front bar 15, which cooperates with a spring-actuated security lock mechanism lever 81, 85. The security lock mechanism levers 82, 85 are flat, generally L-shaped elements having a circular mounting hole at the center of the juncture of the two arms forming the L which cooperates with a pin attached to the security lock mechanism mounting brackets 81, 84 so as to allow the levers 82, 85 to freely rotate through and arc of several degrees about the mounting brackets. The security lock mechanism levers 82, 85 are movably attached to the mounting brackets 81, 84 and are oriented in such a manner that a first arm of the lever 82, 85 points downward in a vertical plane through the plane of the mechanism which is parallel to a vertical plane through the front of the awning box assembly, and the second arm of the lever 82, 85, perpendicular the first arm and in the same vertical plane therewith, points outward toward the ends of the awning box assembly. The first arm of the levers 82, 85 have one end of a spring 83, 86 fixedly attached to the ends thereof. The opposite end of the spring is attached to a post on the security lock mechanism mounting bracket 81, 84. The first arm of each lever also has a concave-shaped cut-out portion on the edge thereof located approximately at the midsection of the arm, which faces outward toward the end of the awning. The cut-out section is capable of cooperating with the rear pivoting joint lock post 42, 52 fixedly attached to the support bar rear pivoting joint 41, 51, when the awning is in the retracted position. The second arm of each lever 82, 85 extends outward toward the end of the front bar 15 and protrudes through a vertical slot of each front bar end plate 16, 17. The end of the second lever arm has a hooked end which faces upward in the vertical plane of the lever.

The spring-actuated levers 82, 85 are capable of assuming a first, or default position, wherein there is no tension in the actuating spring and the cut-out section of the first, or lower lever arm is in a position to engage with the flange on the the support arm rear pivoting joints security lock post 42, 52, and a second position, brought about by the application of a force in the downward direction to the second or upper, horizontal arm of the lever, thereby causing the lever to pivot about its central axis through the mounting bracket 81, 84 and causing the second or lower, vertical arm of the lever to move inwardly in its vertical plane a sufficient distance so as to disengage the cut out section in the arm from the flange of the security lock post 42, 52, when the awning is in the retracted position. This releases the front bar 15 from its position adjacent to the awning box 11 and thereby also permits the awning to be cranked into its extended position. The application of the lowering force to the second or upper, horizontal arm of the lever and the accompanying motion of the first or lower, vertical arm of the lever in an inward direction towards the center of the awning also causes a tensioning of the actuating spring connecting the end of the first, or lower, vertical arm of the lever to the security lock mechanism mounting bracket. When the downward force is removed from the first, or upper, horizontal arm of the lever, the accumulated tension in the actuating spring then causes the lever to be returned to its initial position, wherein the first, or lower, vertical arm of the lever return to a position in which the groove in that arm of the lever is capable of engaging the flange of the security lock post 42, 52.

The front portion of the support arm rear pivoting joint security lock post 42, 52 has a frusto-conical tip, pointing to the front of the awning assembly. The base of this frusto-conical piece constitutes the flange with which the groove on the first, or lower, vertical arm of the security lock mechanism lever engages to hold the front bar 15 against the awning box assembly 11. When the awning is being retracted, the outward beveling of this frusto-conical end piece of the seucrity lock post causes the lever of the security lock mechanism to gradually and automatically be pushed inwardly in a direction towards the center of the awning. At this time, due to the absence of a downward force acting on its second, or horizontal, upper arm, the lever in the untensioned position. As the awning continues to be retracted, tension in the spring accumulates as it is pushed back to conform to the beveling until, the flange of the security lock post, corresponding to the base of the frusto-conical end piece, is reached, whereupon continued retraction of the awning then causes the lever arm to go beyond the flange at which time it snaps back to its untensioned position with the groove on the first, or vertical, lower arm of the lever engaging with the flange of the security lock post formed by the base of the frusto-conical tip. This condition corresponds to a state in which the awning is fully retracted and the front bar 15 is secured to the awning box assembly 11. This interlocking relationship is more clearly seen in FIGS. 11 and 12.

The relationship of the security lock lever to the security lock mechanism mounting bracket and the actuating spring is more clearly shown in FIG. 13.

Figure 7A:
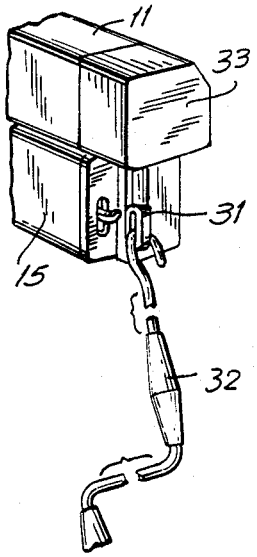
FIGS. 7 A–C are fragmentary perspective views showing the sequence of steps of a method for releasing the security lever mechanism of the awning box assembly and commencing the extension of the awning.
Figure 7B:
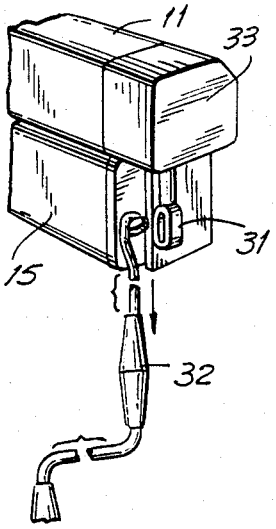
Figure 7C:
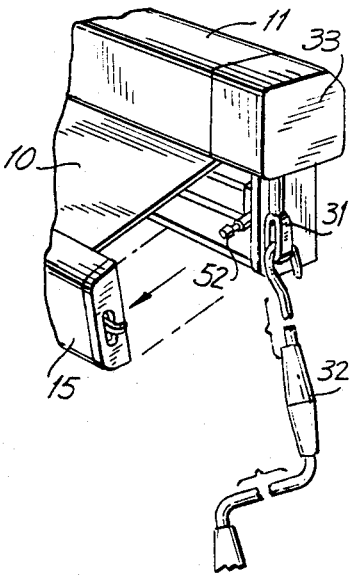

The procedure for unlocking the security lock mechanism 80 and for unwinding the awning 10 from its retracted, storage position is shown in FIGS. 7A–C. In order to release the awning 10 from its retracted position, the crank 32 must first be engaged with the crank stirrup 31 and turned for several turns in an appropriate direction, thereby engaging the roller operating mechanism 30 causing the roller 20 to rotate and the awning 10 to partially unwind from the roller 20. At this point, the front bar 15 is still securely engaged to the awning box assembly 11. The several inches of slack material of the awning 10 which are unwound from the roller as a result of turning the crank are sufficient to enable the front bar 15 to deploy for a short distance beyond the security lock mechanism posts when the security lock mechanism is released. The initial turning of the crank to unwind this short distance of the awning 10 with the front bar 15 still in the locked position is shown in FIG. 7A.

The next step is to remove the crank 32 from the crank stirrup 31 and use the hooked end thereof to sequentially apply a downward force to the security lock mechanism lever 82, 85 at each end of the awning box assembly. This step is illustrated in FIG. 7B. A downward pointing arrow next to the security lock mechanism lever shows the direction in which the downward force is applied to depress the second, or horizontal, upper arm of the lever, thereby causing the cut-out notch on the side of the first, or lower, vertical arm of the lever to disengage from the flange of the security lock post 42, 52. Upon release of the security lock mechanism, the end of the front bar 15 which has just been released, snaps away from the awning box 11 and deploys that end of the awning 10 and front bar 15 for a short distance determined by the length of the awning 10 fabric unwound in the previous step. The same procedure utilizing the crank to depress the lever and release the security lock mechanism is then repeated for the mechanism at the opposite side of the awning box assembly, thereby releasing the other end of the front bar 15 from the box 11 and causing the awning 10 to deploy at that side also for a distance determined by the length of awning 10 fabric unwound in the initial step. The release of the front bar 15 and the deployment of the awning for a short distance is shown in FIG. 7C.

As an alternative to securing the support legs 60, 70 to the ground in the manner as previously described, the support legs 60, 70 may be detachably affixed to the side wall of the vehicle using support leg wall mounting brackets 95. These support leg wall mounting brackets 95 are affixed to the side wall of the vehicle using the same general method as described previously for affixing the basic wall mounting brackets 90 to the top of the vehicle. The support leg wall mounting brackets 95 are designed to receive the footplates 65, 75 at the bottom of the support leg lower sections 63, 73. It can be appreciated that the shape of the support leg wall mounting brackets 95 is determined by the shape of the footplate 65, 75.

The support leg wall mounting brackets 95 have flanges at either end through which holes for accommodating mounting screws 96 are drilled. Corresponding holes to the holes in the flanges of the wall mounting bracket are drilled in the sides of the vehicle. The support leg wall mounting brackets 95 are then fixedly attached to the side wall of the vehicle using the support leg wall mounting bracket screws 96 and nuts 97 affixed to the screws and tightened from inside the vehicle.

Instead of the nuts 97, a support leg wall mounting bracket backplate 98 with threaded receptacles for the screws may alternatively be used to secure the wall mounting brackets 95 from the inside of the vehicle. The method of affixing the wall mounting brackets 95 to the vehicle is shown in detail in FIG. 22. FIG. 23 shows such a wall mounting bracket 95 in place on the side of a vehicle. FIG. 24 shows the method of inserting a footplate 65, 75 into a wall mounting bracket 95.

The footplates 65, 75 preferably have a rubber cushioning pad on the undersides thereof to prevent scratching the side of the vehicle when the legs are attached to the side of vehicle utilizing the vehicle support leg mounting brackets 95.

Figure 28:
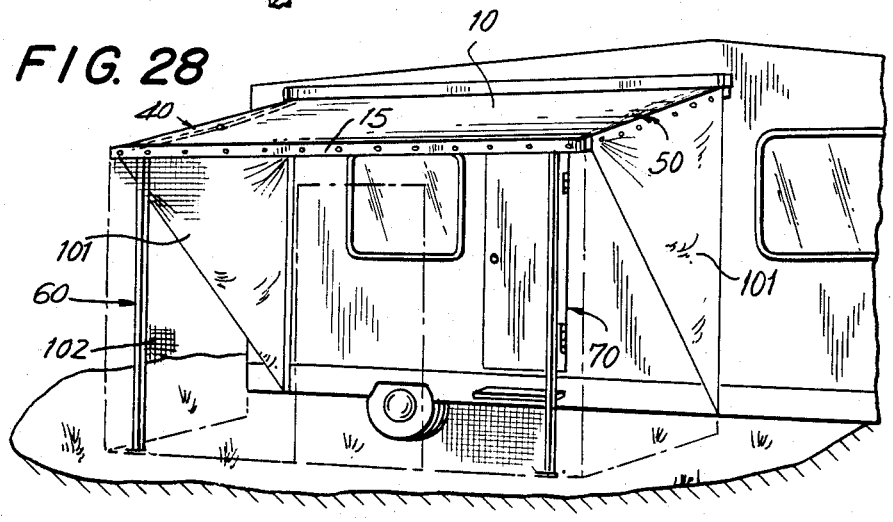
FIG. 28 is a perspective view of an awning assembly in accordance with an alterative embodiment of the invention, the awning being extended and having optional front and side flaps.

One alternative embodiment of the invention provides for the releasable attachment of side 101 and/or front 102 flaps to the awning when in extended position. These side and/or front flaps can be made of the same material as the awning 10 itself. Alternatively, however these side and/or front flaps can be fabricated from a flexible screen-like material so as to provide an enclosure at the side of the vehicle that will keep out flying insects and the like, but which will permit circulation of air into the sheltered area. These optional side and/or front flaps or screens can be releasably attached to the support arms 40, 50 and front bar 15 by conventional means such as with hooks or snaps. It can be appreciated that the side and/or front flaps are most effectively used when the awning is in a fully extended position with the support legs 60, 70 set up in the ground-anchored mode. FIG. 28 shows a typical set up using the optional side and front flaps.

Materials of construction of the elements of the awning assembly not previously specified, including, the support arms and support legs can be of any structural metal or plastic which is weather resistant. Zinc coated stainless steel is a preferred material. Small parts can be plastic fabricated. Suitable materials include polymerized acetal resins such as are manufactured and sold by E.I. Dupont de Nemours & Co. under the name Delrin 500T.

The terms and expressions which have been employed are used as terms of description and not of limitation and there is no intention in the use of such terms and expressions of excluding any equivalents of the features shown and described or portions thereof, it being recognized that various modifications are possible within the scope of the invention.

What is claimed is:

1. A retractable awning assembly for use on recreational vehicles and the like comprising:

a rectangularly shaped rollable fabric awning;

a roller having a length slightly greater than the width of the rectangularly shaped awning to which one end of the awning is attached and around which the awning is capable of being wound;

an elongated box-like housing slightly longer than the length of the roller in which the roller is rotatably mounted and which fully encloses the roller and awning when wound around the roller, except for an opening at the front of the housing through which the awning travels when being extended and retracted;

a roller operating mechanism for causing rotation of the roller which alternatively effects movement of the awning from a position at which it is fully wound around the roller to a position at which it is partly or fully extended and reverse movement;

a front bar to which the end of the awning opposite the end attached to the roller is attached, the front bar having a longitudinally extending channel therein and being releasably secured to the opening on the housing through which the awning travels to complete the enclosure of the roller and awning when wound around the roller;

a pair of articulated, folding support arms for supporting the front bar which has the front end of the awning attached and for supporting the sides of the awning when the awning is in an extended position, the support arms being pivotally attached at one end thereof to the housing and pivotally attached at the opposite end thereof to the front bar, with the folded support arms being capable of storage in the channel within the front bar when the awning is retracted and the front bar is releasably secured to the housing;

a pair of telescoping support legs for further supporting the front bar which has the front end of the awning attached when the awning is in an extended position and for supporting the extended support arms and stabilizing the extended awning by alternatively being anchored to the ground or releasably secured to the side of the vehicle to which the awning is mounted, the support legs being pivotally and rotationally mounted at their upper end to the front bar, with the telescoped support legs being capable of storage in the channel within the front bar when the awning is retracted and the front bar is releasably secured to the housing; and a security lock mechanism for releasably securing the front bar to the housing to prevent the inadvertent detachment of the front bar from the housing and the unwanted unrolling of the awning from the roller, especially when the vehicle to which the awning assembly is mounted is being driven.

2. The retractable awning assembly of claim 1 wherein front and side flaps are releasably attached to the awning assembly when in an extended position.

3. The retractable awning assembly of claim 2 wherein the front and side flaps are releasably attached to the front bar and support arms, respectively.

4. The retractable awning assembly of claim 2 wherein the front and side flaps are of the same fabric material as the awning.

5. The retractable awning assembly of claim 2 wherein the front and side flaps are of a flexible screen-like material.

6. A retractable awning assembly for use on recreational vehicle and the like comprising:

an elongated box-like housing having top and back walls, a partial front wall extending downward from the front of top wall, a partial bottom wall extending forward from the bottom of that said wall, and means for enclosing the ends of the housing;

the housing having an opening in the lower portion of the front side and the front portion of the bottom side;

a roller extending longitudinally and rotatably mounted in the housing;

an awning formed of a rectangular shaped piece of pliable material rolled on the roller and capable of being extended therefrom from a retracted position through the opening in said housing alternatively to a fully extended, position or to a partially extended position between the retracted and extended positions;

a front bar disposed over the opening and cooperating with the housing to form an enclosed case, the front bar having a front wall and top and bottom walls such that the top wall of the front bar communicates with the bottom edge of the partial front wall of the housing and the bottom wall of the front bar communicates with the front edge of the partial bottom wall of the housing, said top and bottom walls defining a storage space therebetween;

means for enclosing the ends of the front bar;

means for releasably securing the front bar to the housing and permitting movement of the front bar out of said opening and away from said housing, the awning having one edge along its width connected to said roller and the opposite edge along its width connected to the front bar to be unrolled and extended from the housing with the movement of the front bar away from the housing;

two jointed, articulated support arms each having first and second sections axially communicating with one another such that an outer end end of each of the first sections is pivotally connected to an adjacent opposite inner end of the second sections, with an inner end of each of the first sections being pivotally connected to the housing at its sides and the outer ends of the second sections being pivotally connected to the front bar at its opposite ends, respectively, such that the second section of each support arms extends along the bottom of the housing toward the center thereof and the first section of each support arm extends along the bottom of the front bar toward the opposite end thereof and in 0 degree pivotal relationship to the first section along a common but oppositely directed linear axis, when the awning is in the retracted position, each of the first and second sections of the support arms being capable of fitting inside said storage space in the front bar when the awning is in the retracted position, the first and second sections of the support arms further being capable of pivoting through a 180 degree arc as the awning is extended at which time the first and second sections of the support arms are positioned along a common linear axis with respect to one another and perpendicular to the housing and the front bar, respectively, the first and second sections of the support arms bearing an angularly pivotal relationship to one another and to the housing and the front bar when the awning is in a partially unrolled position between the fully extended and fully retracted positions;

two support legs, each having first and second sections capable of being telescoped within one another such that an upper end of each of the first sections is attached to the front bar at its opposite ends to permit the support legs to be folded perpendicularly to the front bar, each of the first and second sections of the support legs fitting inside the storage space in the front bar when the awning is in the retracted position, the legs having a further-pivoting means connecting the upper end of each first section to the front bar such that the legs are capable of angularly pivoting with respect to the front bar after being extended perpendicularly thereto, so as to alternatively rest upon the ground or be releasably attached to a side of the vehicle on which the assembly is mounted, thereby giving additional support to the awning and front bar, the legs further having support means attached to a lower end of the second sections thereof capable of alternatively functioning as an anchorable foot pad when the legs are positioned on the ground or as a latch capable of releasably engaging said vehicle;

means mounted on the housing and engaged with the roller to enable its rotational movement thereby causing the awning to alternatively unwind from or wind onto the roller and to move from the retracted position to the extended position and alternatively to positions thereinbetween and back;

locking means for releasably securing the front bar to the housing when the awning is in the retracted position with the front bar communicating with the housing to form an enclosed case; and means for attaching the housing to the vehicle.

7. A retractable awning assembly for use on recreational vehicles and the like comprising:

a rectangularly shaped rollable fabric awning;

a roller having a length slightly greater than the width of the rectangularly shaped awning to which one end of the awning is attached and around which the awning is capable of being wound;

an elongated box-like housing slightly longer than the length of the roller in which the roller is rotatably mounted and which is fabricated from vertically oriented front and back panels, horizontally oriented top and bottom panels and vertically oriented endplates which together form a case for the roller and awning, which is fully enclosed except for an opening at a lower front part thereof through which the awning travels when being extended and retracted, the panels and endplates being arranged such that the front panel extends partially down a front face of the housing and is of shorter length than the back panel which it oppositely faces, the front and back panels being connected by way of the top panel, with the bottom panel being connected to the lower part of the back panel and with the endplates being attached to the ends of the box formed by the top, bottom, front and back panels, with the bottom panel further being of lesser width that the top panel such that the assembly thereby provides the opening through which the awning travels;

a roller operating mechanism for causing rotation of the roller in a direction which effects movement of the awning from a position at which it is fully wound around the roller to a position at which it is alternatively partly and fully extended and alternatively in a direction which effects reverse movement;

a front bar to which the end of the awning opposite the end attached to the roller is attached, the front bar having a longitudinally extending channel therein and being releasably secured to the opening on the housing through which the awning travels to complete the enclosure of the roller and awning when wound around the roller;

a pair of articulated, folding support arms for supporting the front bar which has the front end of the awning attached and for supporting the sides of the awning when the awning is in an extended position, the support arms being pivotally attached at one end thereof to the housing and pivotally attached at the opposite end thereof to the front bar, with the folded support arms being capable of storage in the channel within the front bar when the awning is retracted and the front bar is releasbly secured to the housing;

a pair of telescoping suport legs for further supporting the front bar which has the front end of the awning attached when the awning is in an extended position and for supporting the extended support arms and stabilizing the extended awning by alternatively being anchored to the ground or releasably secured to the side of the vehicle to which the awning is mounted, the support legs being pivotally and rotationally mounted at their upper end to the front bar, with the telescoped support legs being capable of storage in the channel within the front bar when the awning is retracted and the front bar is releasably secured to the housing; and a security lock mechanism for releasably securing the front bar to the housing position to prevent the inadvertent detachment of the front bar from the housing and the unwanted unrolling of the awning from the roller, especially when the vehicle to which the awning assembly is mounted is being driven.

8. The retractable awning assembly according to claim 7 wherein the box-like housing is fabricated from a light weight metal.

9. The retractable awning assembly according to claim 8 wherein the light weight metal is anodized aluminum.

10. A retractable awning assembly for use on recreational vehicles and like comprising:

a rollable fabric awning;

a roller onto and from which the awning is alternatively wound and unwound;

housing means for rotatably mounting the roller and for enclosing the roller and awning when wound onto the roller;

a front bar to which a leading edge of the awning is attached and which forms a releasably attached part of the housing when the awning is in a retracted position, the front bar having a longitudinally extending opening therein;

an electric motor for unwinding and winding the roller to alternatively extend and retract the awning;

means for supporting the awning and front bar when in an extended position, the support means being disposed in the longitudinally extending opening of said front bar when the awning is in its retracted position; and means for preventing the inadvertent unrolling of the awning from the roller and its undesired extension from the housing means.

11. The retractable awning assembly of claim 10 wherein the electric motor is coaxially attached to the roller and provides rotational movement of the roller by direct drive.

12. The retractable awning assembly of claim 10 wherein the electric motor is attached to the roller by a mechanism which converts rotational movement of a motor shaft in one plane perpendicular to the roller into rotational movement of the roller in a perpendicular plane.

13. A retractable awning assembly for use on recreational vehicles and the like comprising:

a rollable awning which is a rectangularly shaped piece of fabric having an actual length ranging from approximately seven feet to thirteen feet to provide an effective extended length ranging from approximately six feet to twelve feet;

a roller having a length slightly greater than the width of the rectangularly shaped awning to which one end of the awning is attached and around which the awning is capable of being wound;

an elongated box-like housing slightly longer than the length of the roller in which the roller is rotatably mounted and which fully encloses the roller and awning when wound around the roller, except for an opening at the front of the housing through which the awning travels when being extended and retracted;

a roller operating mechanism for causing rotation of the roller which alternatively effects movement of the awning from a position at which it is fully wound around the roller to a position at which it is partly or fully extended and reverse movement;

a front bar to which the end of the awning opposite the end attached to the roller is attached, the front bar defining a longitudinally extending storage space and being releasably secured to the opening on the housing through which the awning travels to complete the enclosure of the roller and awning when wound around the roller;

a pair of articulated, folding support arms for supporting the front bar and for supporting the sides of the awning when the awning is in an extended position, the support arms being pivotally attached at one end thereof to the housing and pivotally attached at the opposite end thereof to the front bar, with the folded support arms being capable of storage in the storage space within the front bar when the awning is retracted and the front bar is releasably secured to the housing;

a pair of telescoping support legs for further supporting the front bar having the front end of the awning attached when the awning is in an extended position and for supporting the extended support arms and stabilizing the extended awning by alternatively being anchored to the ground or releasably secured to the side of the vehicle to which the awning is mounted, the support legs being pivotally and rotationally mounted at their upper end to the front bar, with the telescoped support legs being capable of storage in the storage space within the front bar when the awning is retracted and the front bar is relesably secured to the housing; and a security lock mechanism for releasably securing the front bar to the housing to prevent the inadvertent detachment of the front bar from the housing and the unwanted unrolling of the awning from the roller, especially when the vehicle to which the awning assembly is mounted is being driven.

14. The retractable awning assembly of claim 13 wherein the awning fabric is a material which is resistant to deterioration by exposure to adverse weather conditions of sun, rain and wind and which is resistant to deterioration by exposure to external agents such as mold and mildew.

15. The retractable awning assembly of claim 13 wherein the awning fabric is polyester, lined on both sides with polyvinylchloride.

16. The retractable awning assembly of claim 13 wherein the awning is a single rectangular shaped piece of fabric.

17. The retractable awning assembly of claim 13 wherein the awning is made of a plurality of fabric strips welded together.

18. A retractable awning assembly for use on recreational vehicles and the like comprising:

a rectangularly shaped rollable fabric awning;

a roller having a length slightly greater than the width of the rectangularly shaped awning to which one end of the awning is attached and around which the awning is capaable of being wound;

an elongated box-like housing slightly longer than the length of the roller in which the roller is rotatably mounted and which fully encloses the roller and awning when wound around the roller, except for an opening at the front of the housing through which the awning travels when being extended and retracted;

a roller operating mechanism for causing rotation of the roller in a direction which effects movement of the awning from a position at which it is fully wound around the roller to a position at which it is alternatively partly and fully extended and alternatively in a direction which effects reverse movement;

a front bar to which the end of the awning opposite the end attached to the roller is attached, the front bar defining a longitudinally extending storage space and being releasably secured to the opening on the housing through which the awning travels to complete the enclosure of the roller and awning when wound around the roller;

a pair of articulated, folding support arms for supporting the front bar, each of the folding support arms having a rear pivoting joint which is fixedly attached to an end of the box-like housing;

a rear arm section;

a front arm section pivotally connected to the rear arm section to enable the arm front and rear sections to fold onto one another; and a front pivoting joint pivotally attached to the front end of the front arm section and fixedly attached to the front bar, with the folded support arms being capable of storage in the storage space within the front bar when the awning is retracted and the front bar is releasably secured to the housing;

a pair of telescoping suport legs for further supporting the front bar having the front end of the awning attached when the awning is in an extended position and for supporting the extended support arms and stabilizing the extended awning by alternatively being anchored to the ground or releasably secured to the side of the vehicle to which the awning is mounted, the support legs being pivotally and rotationally mounted at their upper end to the front bar, with the telescoped support legs being capable of storage in the storage space within the front bar when the awning is retracted and the front bar is releasably secured to the housing; and a security lock mechanism for releasably securing the front bar to the housing to prevent the inadvertent detachment of the front bar from the housing and the unwanted unrolling of the awning from the roller, especially when the vehicle to which the awning assembly is mounted in being driven.

19. The retractable awning assembly of claim 18 wherein the support arm front and rear sections are rectangularly shaped tubular members which are actuated in response to movement of the awning initiated by the roller operating mechanism and which support arm front and rear sections in addition to being pivotally jointed, further cooperate with one another by means of a spring and cable mechanism positioned inside the tubular members, such that the rear section is connected to the rear pivoting joint, the front and rear sections are connected to one another and the front section is connected to he front pivoting joint by the spring having one end thereof attached to the rear pivoting joint and the opposite end thereof attached to one end of the cable which runs through the front and rear tubular sections and has its other end attached to the front pivoting joint.

20. A retractable awning assembly for use on recreational vehicles and the like comprising:

a rectangularly shaped rollable fabric awning;

a roller having a length slightly greater than the width of the rectangularly shaped awning to which one end of the awning is attached and around which the awning is capable of being wound;

an elongated box-like housing slightly longer than the length of the roller in which the roller is rotatably mounted and which fully encloses the roller and awning when wound around the roller, except for an opening at the front of the housing through which the awning travels when being extended and retracted;

a roller operating mechanism for causing rotation of the roller which alternatively effects movement of the awning from a position at which it is fully wound around the roller to a position at which it is partly or fully extended and reverse movement;

a front bar to which the end of the awning opposite the end attached to the roller is attached the front bar defining a longitudinally extending storage space and being releasably secured to the opening on the housing through which the awning travels to complete the enclosure of the roller and awning when wound around the roller;

a pair of articulated, folding support arms for supporting the front bar having the front end of the awning attached and for supporting the sides of the awning when the awning is in an extended position, the support arms being pivotally attached at one end thereof to the housing and pivotally attached at the opposite end thereof to the front bar, with the folded support arms being capable of storage in the storage space within the front bar when the awning is retracted and the front bar is releasably secured to the housing;

a pair of telescoping support legs for further supporting the front bar having the front end of the awning attached when the awning is in an extended position and for supporting the extended support arms and stabilizing the extended awning by alternatively being anchored to the ground or releasably secured to the side of the vehicle to which the awning is mounted, each one of the pair of telescoping support legs having an upper leg section, pivotally and rotationally attached to one of the ends of the front bar;

a lower leg section into which the upper leg section telescopes;

a knob attached to the lower leg section for tightening the upper and lower leg sections at a selected height;

a footplate pivotally attached to the bottom at the lower leg section for alternatively resting the support leg on the ground or attaching the support leg to a side of the vehicle, with the telescoped support legs being capable of storage in the storage space within the front bar when the awning is retracted and the front bar is releasably secured to the housing; and a security lock mechanism for releasably securing the front bar to the housing position to prevent the inadvertent detachment of the front bar from the housing and the unwanted unrolling of the awning from the roller, especially when the vehicle to which the awning assembly is mounted is being driven.

* * * * *